United States Patent [19]

Werych

[11] 3,985,946

[45] Oct. 12, 1976

[54] REMOVABLE HEATING ELEMENT FOR HIGH TEMPERATURE FURNACES

[75] Inventor: Ewald R. Werych, Elm Grove, Wis.

[73] Assignee: Sola Basic Industries, Inc., Milwaukee, Wis.

[22] Filed: Feb. 18, 1975

[21] Appl. No.: 550,291

[52] U.S. Cl. ..... 13/20; 13/25; 219/403

[51] Int. Cl.[2] ..... F27D 11/02

[58] Field of Search ..... 13/20, 22, 25; 219/403, 219/388, 395, 402, 409, 424, 553

[56] References Cited

UNITED STATES PATENTS

| | | | |
|---|---|---|---|
| 2,649,487 | 8/1953 | Phillips | 13/25 X |
| 2,721,920 | 10/1955 | Weide | 13/20 X |
| 3,259,527 | 7/1966 | Beggs | 13/25 X |
| 3,729,570 | 4/1973 | Beck | 13/20 X |

FOREIGN PATENTS OR APPLICATIONS

| | | | |
|---|---|---|---|
| 770,071 | 9/1934 | France | 13/25 |

*Primary Examiner*—R. N. Envall, Jr.
*Attorney, Agent, or Firm*—Smythe & Moore

[57] ABSTRACT

The roof of the heating chamber in a refractory furnace is made of refractory or brick with vertical holes therein and a number of hooks or holding means are suspended in these holes. The hooks project into the heating chamber and an electrical heating element means is suspended on the hooks. In order to remove the heating elements, a plastic bag is used which has its open edge fastened to the top surface of the furnace to enclose an opening in the furnace through which the heating element and the bricks or holding means to which the heating element is attached can be withdrawn. The bag is of sufficient size to enclose the entire assembly when withdrawn from the furnace. The parts are arranged so that another element can be placed in the furnace by another bag so that gaseous contents of the furnace are kept in the furnace.

10 Claims, 12 Drawing Figures

FIG. 4
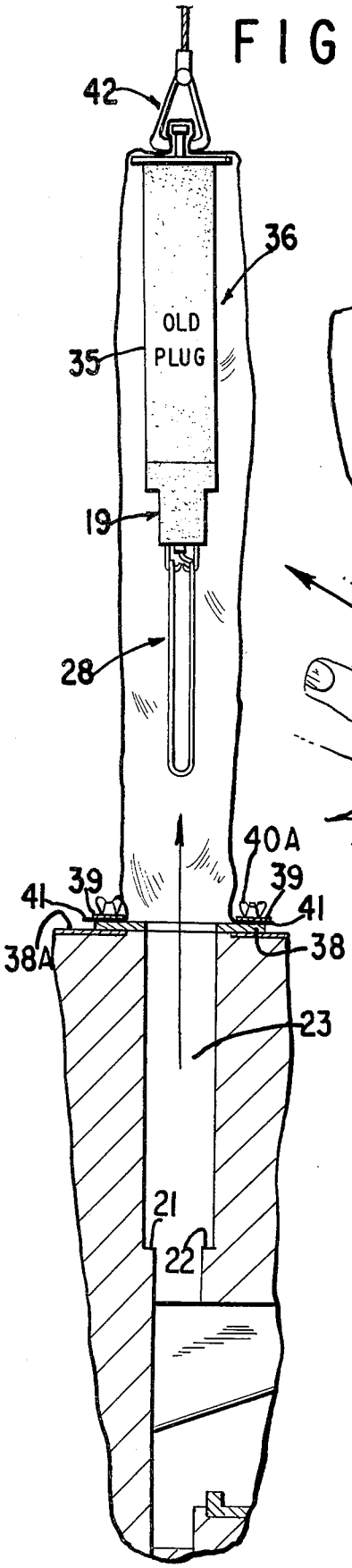
FIG. 7
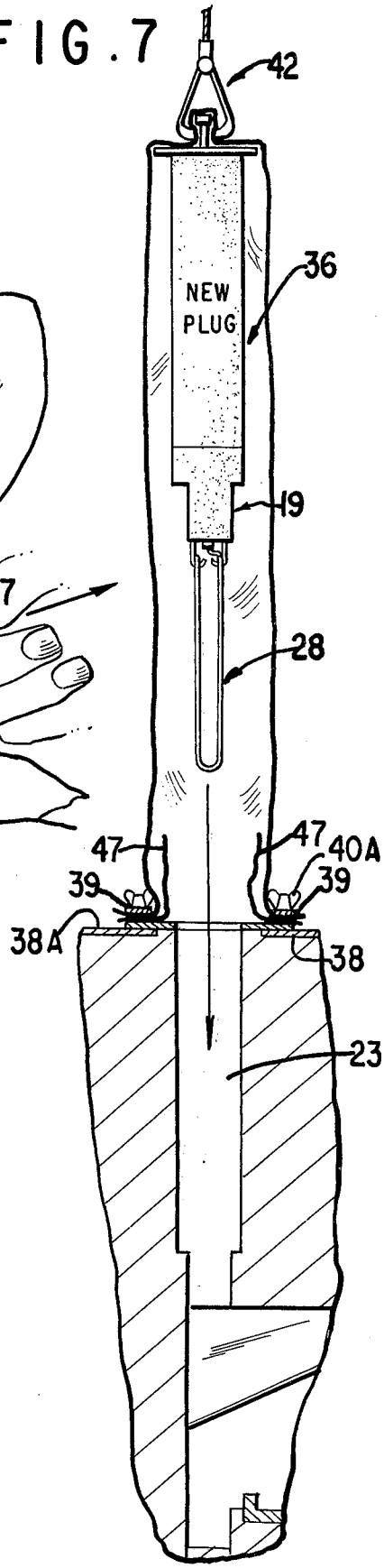
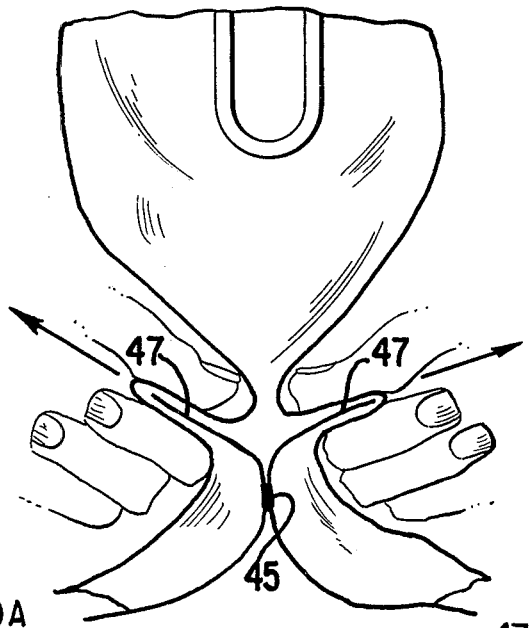
FIG. 6

REMOVABLE HEATING ELEMENT FOR HIGH TEMPERATURE FURNACES

The present invention relates to an electrically heated furnace and, more particularly, to mounting a removable electric heating element in such a furnace and to the element structure.

High temperature atmosphere refractory furnaces have been used for the sintering of uranium and plutonium. When processing plutonium, the contamination in the plutonium oxide is so great that no portion of the inner furnace heating chamber can be exposed to the room in which the furnace is located or to any human being without the possibility of danger. In order to have such a furnace which can be serviced, it is necessary that the heating element be capable of being replaced without opening the interior of the furnace so that it has free access to the atmosphere or area in which it is located. In known furnaces, there are provided at least two sets of electrical heating elements along each side wall of the heating chamber. These sets of elements are positioned above and below each other and are hung from pins extending from the side walls of the chamber. The use of such sets of heating elements is necessary in order to obtain sufficient electrical energy in order to raise the temperature of the heating chamber to the order of about 1800° C. When the heating elements are suspended from pins in the side walls of the heating chamber, they can not be removed without gaining access to the heating chamber.

One of the objects of the present invention is to provide an improved removable electrical heating element for high temperature furnaces.

Another of the objects is to provide an improved protective arrangement for the heating element assembly when it is removed from the furnace.

A still further object is to provide an improved heating element construction.

According to one aspect of the present invention, there may be provided a refractory furnace structure comprising a plurality of refractory bricks or shapes defining a heat treating chamber having a roof, side walls and a hearth or bottom wall. One of the bricks of the roof adjacent a side wall has a plurality of vertical holes or apertures therethrough in which are supported a plurality of rod elements having hooks or other anchoring means thereon so that the hooks extend into the heating chamber or the heating elements can be suspended therefrom. An electrical heating element is suspended on the hooks and has leads extending upwardly through the brick. In order to remove an element, a plastic bag can have its edge mounted to the top surface on the furnace around the opening through which the heating element is to be withdrawn. Upon withdrawal of the heating element assembly, the plastic bag encloses the heating element. Then another element can be inserted by covering the new element with a bag and fastening the new bag over the old one. The heating element then is inserted downwardly into the furnace after the first sealed bag is opened.

The heating element can be formed of two rows of alternating U-shaped bends or rods.

Other objects, advantages and features of the present invention will become apparent from the accompanying description and drawings, which are merely exemplary.

In the drawings:

FIG. 4 is a portion of the view of FIG. 2 and showing the plug assembly withdrawn into the plastic bag;

FIG. 6 is an enlarged view of the bag portion which is to be cut, of FIG. 5, showing the manner in which the old bag is pulled apart prior to the insertion of a new element contained in a new bag;

FIG. 7 is a view similar to that of FIG. 4 and showing a new element to be inserted into the furnace;

Proceeding next to the drawings wherein like reference symbols indicate the same parts throughout the various views, a specific embodiment of the present invention will be described in detail.

Figure 1:
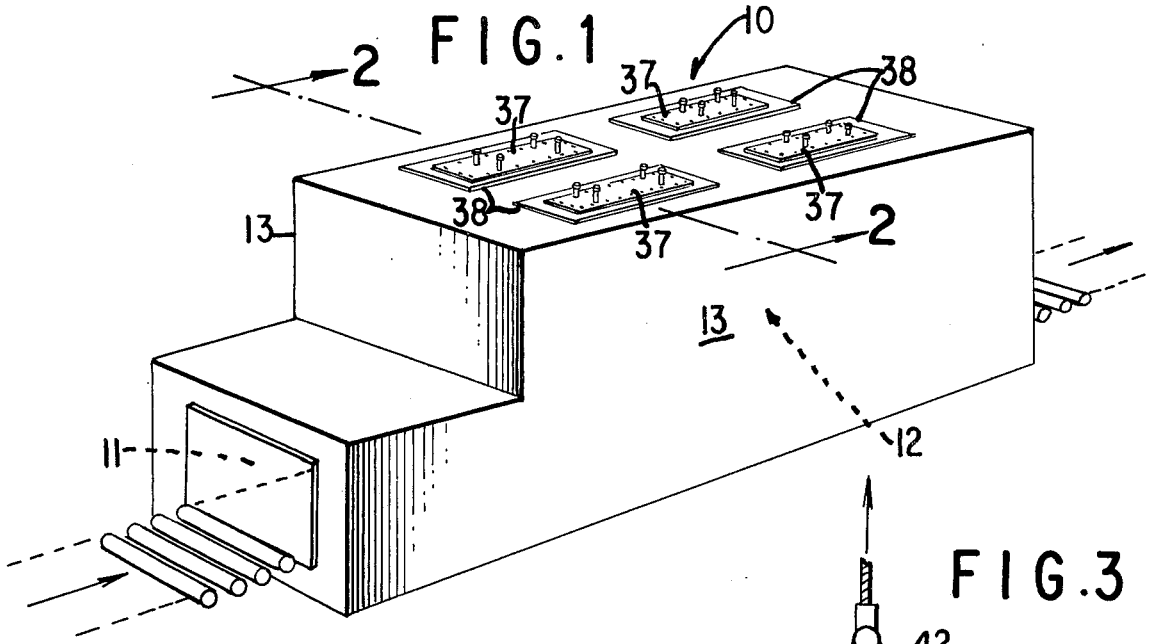
FIG. 1 is an overall perspective view of a high temperature furnace incorporating the present invention.
Figure 3:
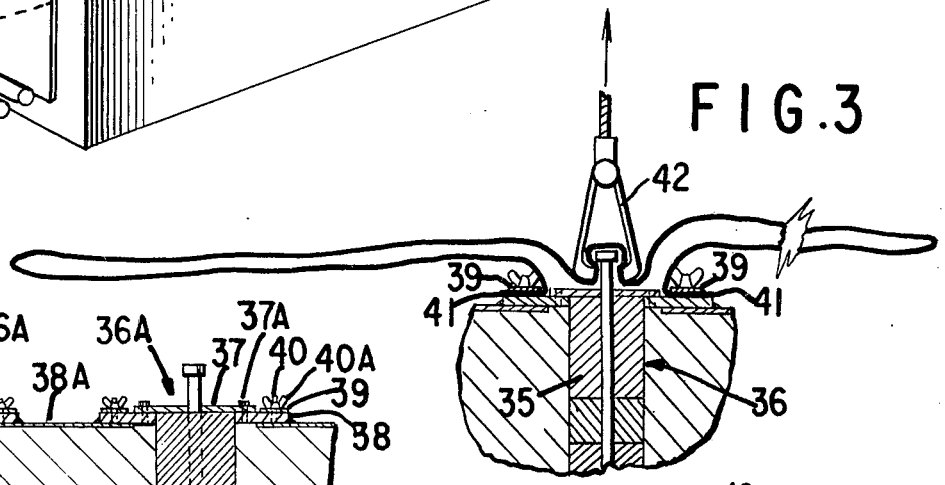
FIG. 3 is a portion of the view of FIG. 2 and showing in addition a plastic bag secured to the top surface of the furnace.

In FIG. 1, there is indicated generally at 10 a high temperature furnace having a refractory construction comprising a plurality of shaped refractory bricks assembled so that the furnace is provided with an elongated heating chamber or tunnel 11 extending therethrough.

Figure 2:
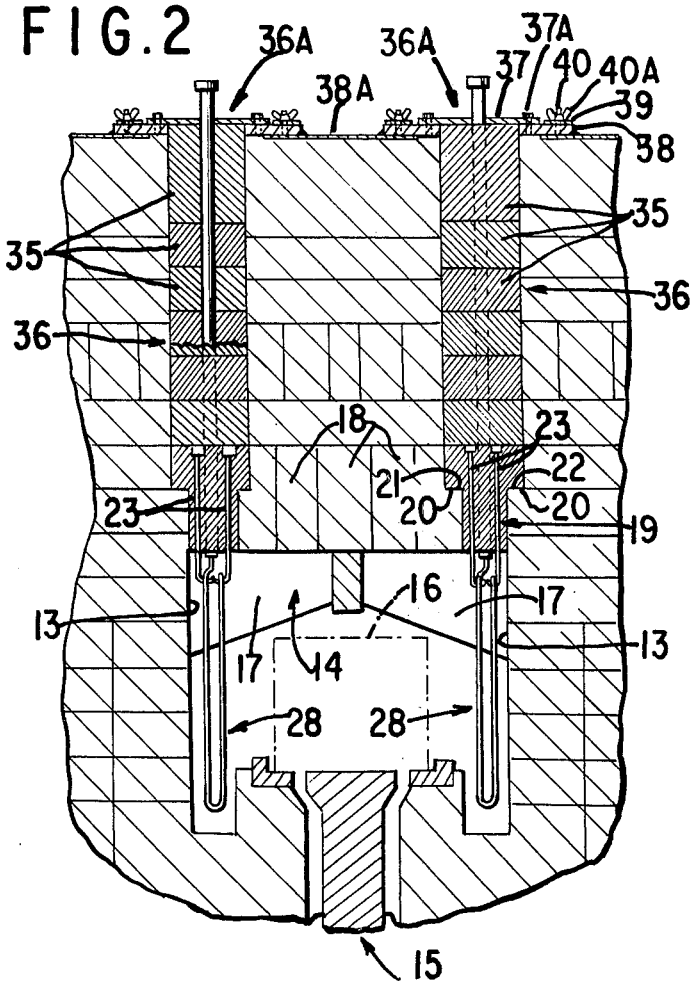
FIG. 2 is a sectional view taken along the line 2—2 of FIG. 1.
Figure 5:
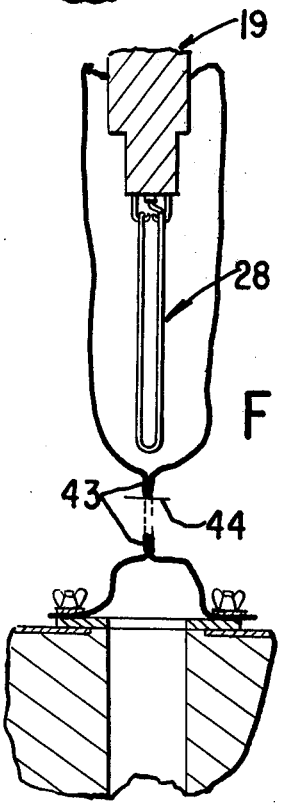
FIG. 5 is a view similar to that of FIG. 3 but showing the plug assembly in the withdrawn position and designating the portion of the bag which is to be cut.

In approximately the central portion of the chamber, there is defined a heating zone 12 having side walls 13 and an arched roof 14 (FIG. 2). A suitable conveyor, such as indicated at 15, is provided to convey containers 16 containing workpieces through the heating chamber.

The roof 14 of the heating chamber comprises a plurality of longitudinally spaced transversely extending rafters 17 between which are mounted a plurality of longitudinally extending roof bricks 18. The portion of the roof 14 adjacent the side walls 13 is formed by a refractory brick 19 shown in greater detail in FIG. 11. The refractory brick 19 is provided with a pair of horizontally longitudinally extending shoulders 20 which rest upon a corresponding shoulder 21 on an adjacent roof brick and a corresponding shoulder 22 on an adjacent side wall brick.

Figure 8:
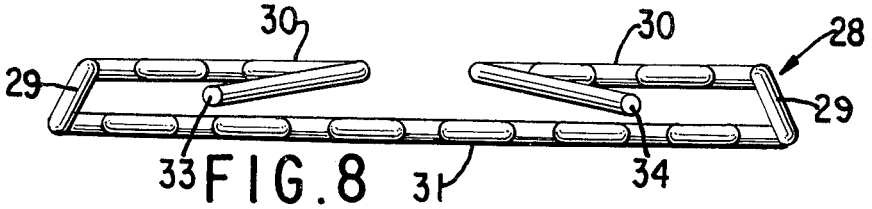
FIG. 8 is a top plan view of the electrical heating element according to the present invention.
Figure 9:
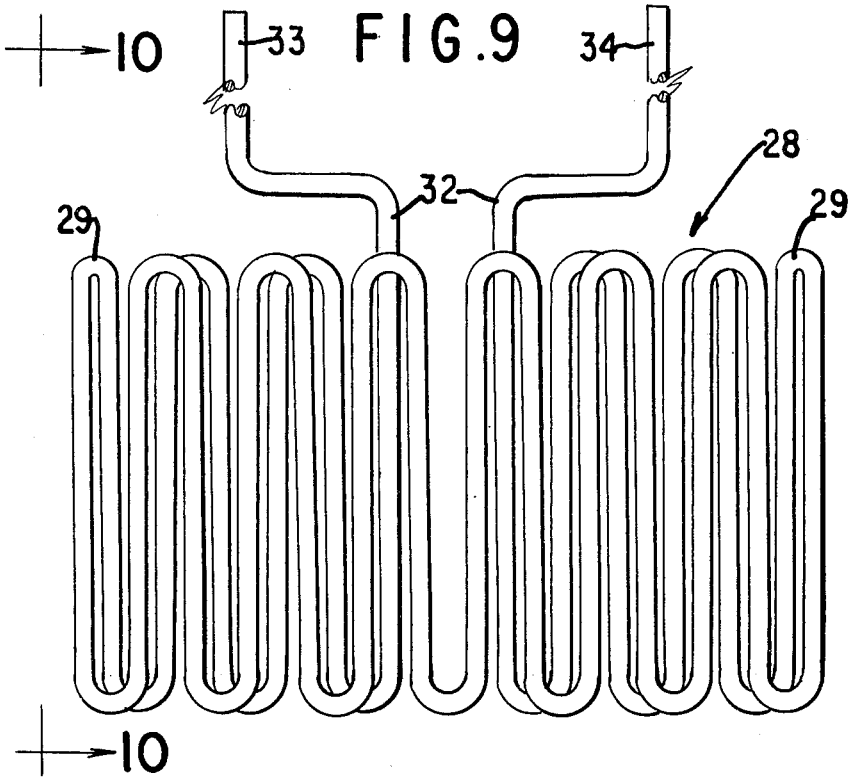
FIG. 9 is a side elevational view of the heating element of FIG. 8.
Figure 11:
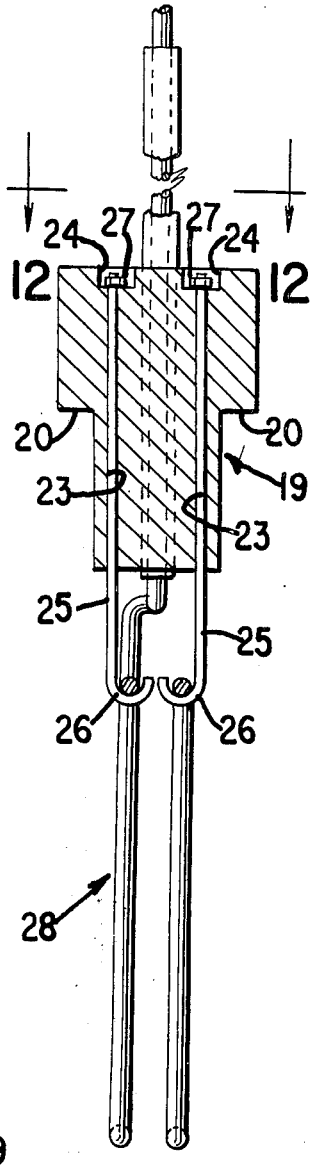
FIG. 11 is a sectional view of the roof brick from which the heating element is suspended.
Figure 10:
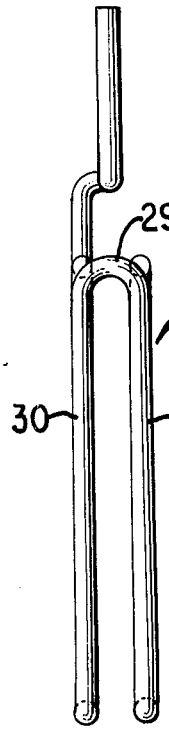
FIG. 10 is an end view of the heating element viewed in the direction of the line 10—10 of FIG. 9.
Figure 12:
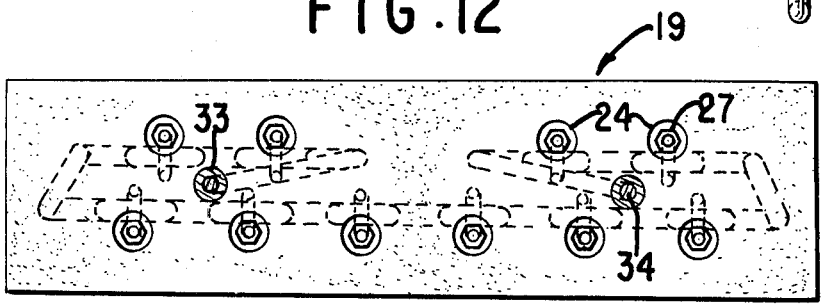
FIG. 12 is a top plan view taken along the line 12—12 of FIG. 11.

The brick 19 has a plurality of vertical apertures 23 extending therethrough, the upper end of each aperture being countersunk or recessed as shown at 24 (FIG. 11). Within each hole 23 is a rod 25 on the lower end of which is a hook or suitable holding means 26. The upper end of the rod 25 is provided with an enlarged portion or nut 27 which is seated in the recess 24. Suspended on the hooks 26 is an electrical heating element indicated generally at 28 and shown in greater detail in FIGS. 8 to 10. The heating element 28 is made of tungsten, molybdenum or other suitable material. The element consists of a continuous double rod-like element bent to form a series of U-shaped or reversed bends and then doubled over at 29 so as to form two parallel or substantially parallel rows 30 and 31 of alternating U-shaped bends. By doubling over the heating element, the space occupied by the heating element is significantly reduced while the heating capacity of the element remains the same. The ends of the heating element are brought together at 32 near the center of row 30 and then bent as shown in FIG. 9 to extend in parallel at 33 and 34 upwardly through the brick 19 and a plurality of insulating bricks or plugs 35 to project above the uppermost of the bricks as indicated at 36A. The projecting tip of the heating element 28 may be water-cooled. The vertical portion of the two rows of rods are offset relative to each other to provide uninhibited radiation.

The hooks 26 which are mounted in the brick or element support plug 19 may be of tungsten.

The heating element 28, the elements supporting plug 19 and the column of insulating bricks 35 together form a plug assembly indicated generally at 36 and illustrated in FIGS. 4 and 7. A plate 37 is fastened to the upper end of the refractory column 35 of the plug assembly and is bolted at 37A around its periphery to a flange 38 fastened on the upper surface 38A of the furnace 10 and surrounding the opening through which the plug assembly 35 is passed. There are a series of similar flanges and plates along the entire length of the heat-treating chamber on both sides thereof so as to have heating elements hanging adjacent both of the side walls.

A smaller flange or frame 39 is secured to the flange 38 by means of a plurality of studs 40 and which have wing nuts 40A thereon. When it is desired to open or remove an element, the outer edge of the opening of a plastic bag 41 is secured underneath the frame 39. The plastic bag is of such size so as to readily accommodate the entire plug assembly 19 and is positioned over the plug assembly prior to the removal of the plug assembly from the furnace as shown in FIG. 4. A suitable securing hook or clamp assembly 42 is attached to the upper end of the plug assembly for raising, lowering and transporting the plug assembly. The assembly also could be raised by hand.

In order to remove the plug assembly 19, the entire assembly is raised from the furnace into the position as shown in FIG. 4. The bag is then sealed at 43 by a bar or suitable sealer and then cut at 44 to separate the plug assembly which is completely enclosed in the plastic bag.

In order to insert a new plug assembly, a new bag is positioned on top of the new assembly and the flange 39 removed so that the new bag can be clamped underneath. The first bag is then torn open manually at 45 as indicated at FIG. 6 to form the free ends 47 as shown in FIG. 7. The new plug assembly is then lowered and the bag can be removed and the plate 37 fastened to the flange 38. Thus, there is no physical contact between the heating element and the side walls. The plug assembly is so designed that it is self-supporting from the top flange because the leads pass through the refractory column 35 directly to the heating element.

By using a tungsten heating element and building up the furnace with a zirconium inner surface backed up with a high purity alumina, it is possible to obtain temperatures of 2000° C.

It will be understood that changes in various details of construction and arrangement of parts may be made without departing from the spirit of the invention except as defined in the appended claims.

What is claimed is:

1. In an electrically heated refractory furnace, the combination of a refractory structure comprising a plurality of refractory brick means defining a heat treating chamber having a roof, one of the brick means of said roof being unitarily removable and having a plurality of vertical apertures therethrough, a plurality of rod elements supported within said apertures and having holding means on the lower ends thereof extending through said one of said brick means into said heating chamber, and an electrical heating element means suspended on said holding means and having leads extending upwardly through said brick means.

2. In an electrically heated refractory furnace as claimed in claim 1 wherein the holding means are hooks.

3. In an electrically heated refractory furnace as claimed in claim 1 wherein said electrical heating element comprises a continuous elongated element bent into two rows of alternating U-shape bends.

4. In an electrically heated refractory furnace as claimed in claim 3 wherein the ends of said element come together at the upper center of one of said rows and are bent upwardly to extend in parallel toward said one brick means.

5. In an electrically heated refractory furnace as claimed in claim 3 wherein said holding means are hooks which are engaged beneath certain ones of the upper U-shaped bends of said electrical heating element.

6. In an electrically heated refractory furnace, the combination of a refractory structure comprising a plurality of refractory bricks defining a heat treating chamber having a roof, one of the brick means of said roof having a plurality of vertical apertures therethrough, a plurality of rod elements supported within said apertures and having holding means on the lower ends thereof extending into said heating chamber, an electrical heating element means suspended on said holding means and having leads extending upwardly through said brick means, and a plastic bag having its opening attachable to the top surface of said furnace above said one brick means so as to enclose said one brick means and heating elements when they are withdrawn from the furnace.

7. In an electrically heated refractory furnace, the combination of a refractory structure comprising a plurality of refractory bricks defining a heat treating chamber having a roof, one of the brick means of said roof having a plurality of vertical apertures therethrough, a plurality of rod elements supported within said apertures and having holding means on the lower ends thereof extending into said heating chamber, an electrical heating element means suspended on said holding means and having leads extending upwardly through said brick means, said refractory structure comprising a column of refractory bricks on top of said one brick means to define together with said one brick means and said electrical heating element a plug assembly, a metal plate on the top of said column and fastened to the furnace structure around its peripheral edge, and a plastic bag of a size sufficient to enclose said plug assembly when withdrawn from the furnace having its opening secured under the peripheral edge of said metal plate.

8. In an electrically heated refractory furnace as claimed in claim 7 and a metal flange mounted on the top of said furnace surrounding said plug assembly and projecting peripherally of said metal plate, said metal plate mounted on top of said metal flange, said plastic bag mounted on said metal flange.

9. An electrical heating element for a refractory furnace comprising a continuous elongated heating element bent into two substantially parallel rows of alternating U-shaped bends wherein the ends of said elongated element extend from a zone adjacent the center of one of said rows.

10. An electrical heating element as claimed in claim 9 wherein the ends are supported by hooks held on rods extending through refractory brick plug means that are unitarily removable from said furnace.

* * * * *